US005647711A

United States Patent [19]

Berger

[11] Patent Number: 5,647,711

[45] Date of Patent: Jul. 15, 1997

[54] FASTENING DEVICE FOR DRAWER RAILINGS

[75] Inventor: Horst Berger, Bielefeld, Germany

[73] Assignee: MEPLA - Werke Lautenschläger GmbH & Co. KG, Germany

[21] Appl. No.: 641,567

[22] Filed: May 1, 1996

[30] Foreign Application Priority Data

May 17, 1995 [DE] Germany ..... 29507834

[51] Int. Cl.[6] ..... F16B 23/00; F16B 45/00

[52] U.S. Cl. ..... 411/400; 411/107; 411/401

[58] Field of Search ..... 411/107, 340, 411/400, 401, 180, 485; 312/348.4

[56] References Cited

U.S. PATENT DOCUMENTS

| | | | |
|---|---|---|---|
| 2,098,997 | 1/1937 | Bramming | 411/401 X |
| 2,379,752 | 7/1945 | Schultz | 411/400 X |
| 3,463,525 | 8/1969 | Stewart | 411/400 X |
| 4,046,181 | 9/1977 | Barnsdale | 411/180 |

FOREIGN PATENT DOCUMENTS

| | | |
|---|---|---|
| 0274683 | 11/1987 | European Pat. Off. . |
| 4335393 | 4/1995 | Germany . |

*Primary Examiner*—Neill R. Wilson
*Attorney, Agent, or Firm*—Dvorak and Traub

[57] ABSTRACT

Arrangement for fastening a hollow railing (10) to the front (24) of a drawer. A blind bore (26) is created on the back of the drawer front. The threaded shaft (20) of a fastener having a fastening head (22) of larger diameter, which can be inserted into the bore, is screwed into the front end of the railing. The fastening head tapers from its end at the railing towards its free end such that its upper generatrix is parallel over most of its length with the railing, and its lower generatrix slopes downwardly from the free end of the fastening head over most of its length. Near the free end of the fastening head at least one knife-edged projection reaching radially upwardly is provided and its cutting edge runs more or less circumferentially.

7 Claims, 2 Drawing Sheets

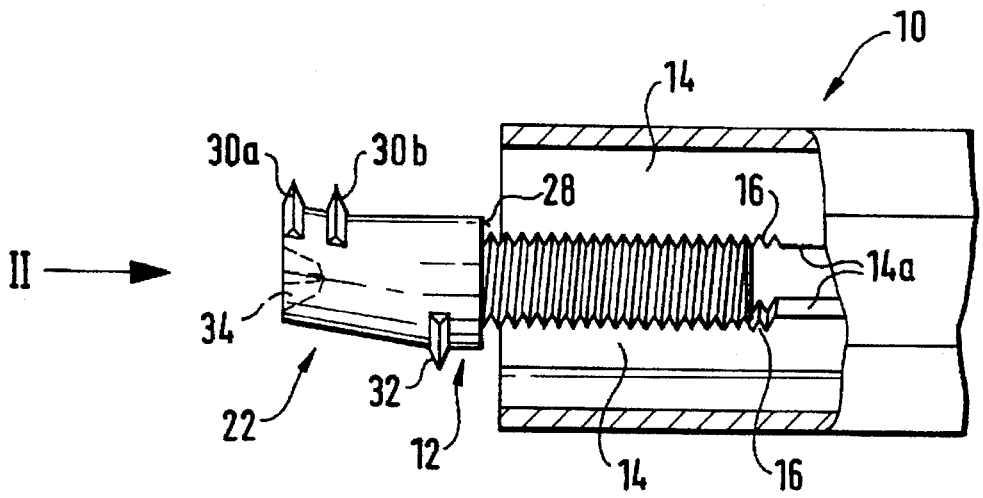
FIG. 1
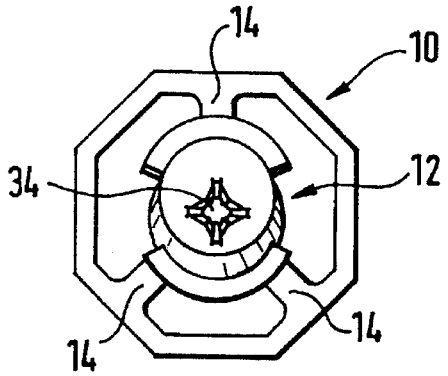
FIG. 2
FIG. 3
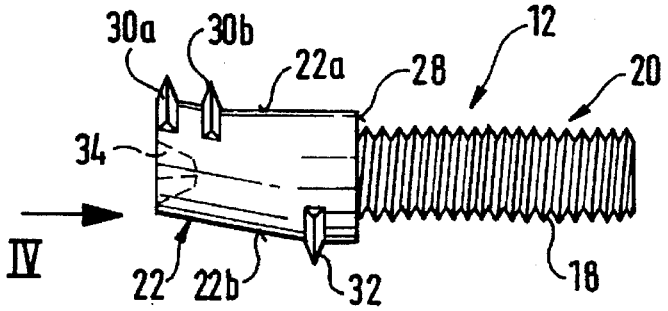
FIG. 4
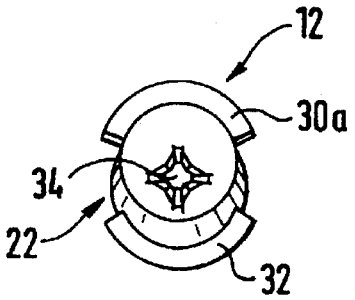

FASTENING DEVICE FOR DRAWER RAILINGS

The invention relates to an arrangement for attaching the hollow rod of a drawer railing to the front of the drawer.

BACKGROUND

Drawer fronts in modern furniture are today fastened adjustably to the sides (and bottom) of drawers by means of appropriate hardware so as to be able to adjust them precisely with respect to their alignment with the fronts of adjacent drawers and center them on the side walls of cabinets while the cabinet is already assembled. In the case of drawers which are intended to hold objects of great height, only the drawer front and back wall are often made of appropriate height, while the drawer sides have the height of normal drawers. In these cases at least one railing fastened to the drawer front and drawer back is provided which is disposed parallel to and above each drawer side and which stabilizes the drawer in general. The ends of the railings are attached to the drawer front and back by means of special hardware devices, of which the device for fastening the front end of the railing has, as a rule, a projecting piece which can be screwed or otherwise fastened to the inside of the drawer front, and to which an additional piece can be releasably attached to the associated front end of the railing, while the actual hardware is then as a rule also covered by a sleeve that is displaceable lengthwise on the railing for aesthetic and safety reasons.

SUMMARY OF THE INVENTION

The invention, however, is addressed to the problem of creating a fastening arrangement for the drawer-front end of the railing which will permit a simple and quick fastening of the railing to the drawer front without being noticeable after assembly is complete.

Setting out from a fastening arrangement of the kind described above, this problem is solved by the invention in that the drawer front has on its back a blind bore where the railing is to be attached, and a threaded shaft of a fastener is screwed into the drawer-front end of the railing. This threaded piece has a fastening head of larger diameter than the threaded shaft, which can be inserted into the blind bore. The fastening head tapers toward its free end such that the upper half of the circumference of its middle section, from the railing end is parallel over most of its length to the railing, and the bottom half slopes downwardly from the free end of the fastening head over most of its length. At the free end of the fastening head at least one knife-edged projection extending radially upward is provided, whose cutting edge runs more or less circumferentially. The attachment of the railing to the drawer front is then performed by introducing the fastening head, before it is fully screwed into the end of the rail, into the blind bore at an angle such that the slanting bottom half of its circumference is in contact with the wall of the bore. In this position the fastening head can enter all the way into the bore, since the upper knife-edges are lowered sufficiently to avoid interference with the area of the wall facing them. As soon as the fastening head is fully inserted into the bore the railing is then lowered to the horizontal position in which the free end of the fastening head is lifted and the knife-edged projection penetrates into the wall of the bore and thus the fastening head is positively locked in the bore. By rotating the railing in the tightening direction on the threaded shaft of the fastening head, the end of the railing is drawn against the inner face of the drawer front, and thus conceals any gap that might be present at that point.

In an advantageous embodiment of the invention, at least one knife-edged projection reaching radially downward is also provided on the fastening head adjacent the end of the rail, and its edge also runs more or less circumferentially. When the railing is installed in the manner described above, this downwardly reaching projection also penetrates into the wall of the bore, thus providing additional purchase for the fastening head.

In an advantageous embodiment of the invention, two knife-edged projections offset from one another lengthwise can be provided at the free end of the fastening head, in which case the configuration can then be made such that the upper generatrix between these two knife-edged projections will be more or less parallel to the bottom generatrix.

The downwardly reaching knife-edged projection adjacent the end of the railing is best provided at some distance from the base of the fastening head so as to prevent it from being broken out of the drawer front by the force applied when the head is installed.

The section of the bottom generatrix of the fastening head between the base of the latter and the downwardly reaching knife-edged projection is then best made more or less parallel to the bottom generatrix of the rail.

To guarantee a secure anchoring of the knife-edged projections in the bore, an embodiment is desirable in which the vertical distance measured in the midsection above the cutting edge of the upwardly reaching projection and that of the downwardly reaching projection is greater than the diameter of the bore provided in the drawer front.

BRIEF DESCRIPTION OF THE DRAWINGS

The invention is further explained in the following description of an embodiment, in conjunction with the drawing, wherein:

FIG. 1 shows the drawer-front end of a railing partially cut away along a vertical center plane, with a fastener provided at this end which can be installed in a bore in a drawer front;

FIG. 2 a view seen in the direction of arrow 2 of FIG. 1;

FIG. 3 a side view of the fastener;

FIG. 4 a view of the fastener seen in the direction of arrow 4 in FIG. 3;

DETAILED DESCRIPTION

Figure 5:
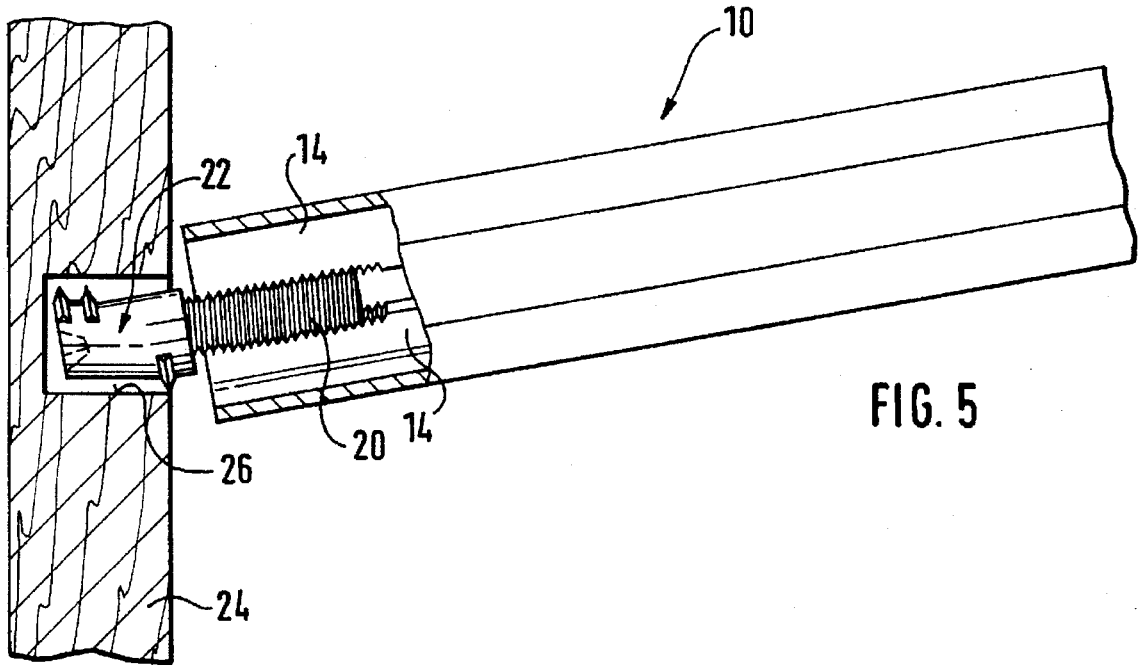
FIG. 5 the drawer-front end of a railing represented in a manner comparable to FIG. 1 in the act of installation in the bore in a drawer front, and FIG. 6 the railing in the intended position on the drawer front at the end of the installation procedure.

In FIGS. 1 and 2 there is shown the drawer-front end of a hollow railing 10 in which the fastener 12, still to be shown separately in FIGS. 3 and 4, is set in place. The hollow railing 10, made, for example, by extrusion from an appropriate aluminum alloy, has in this case the octagonal cross section seen in FIG. 2. In the hollow interior of the railing 10, three angularly offset ribs 14 project, each toward the central axis of the rail; the height of the longitudinal ribs 14 being selected such that they do not contact one another but their end faces 14*a* lie on a common diameter. An internal thread 16 is cut or rolled in the faces 14*a* of the ribs 14 in the end portions 14*a* of the railing 10, and into it there can be screwed a shaft 20 provided with an external thread 18 complementary to the internal thread 16.

Figure 6:
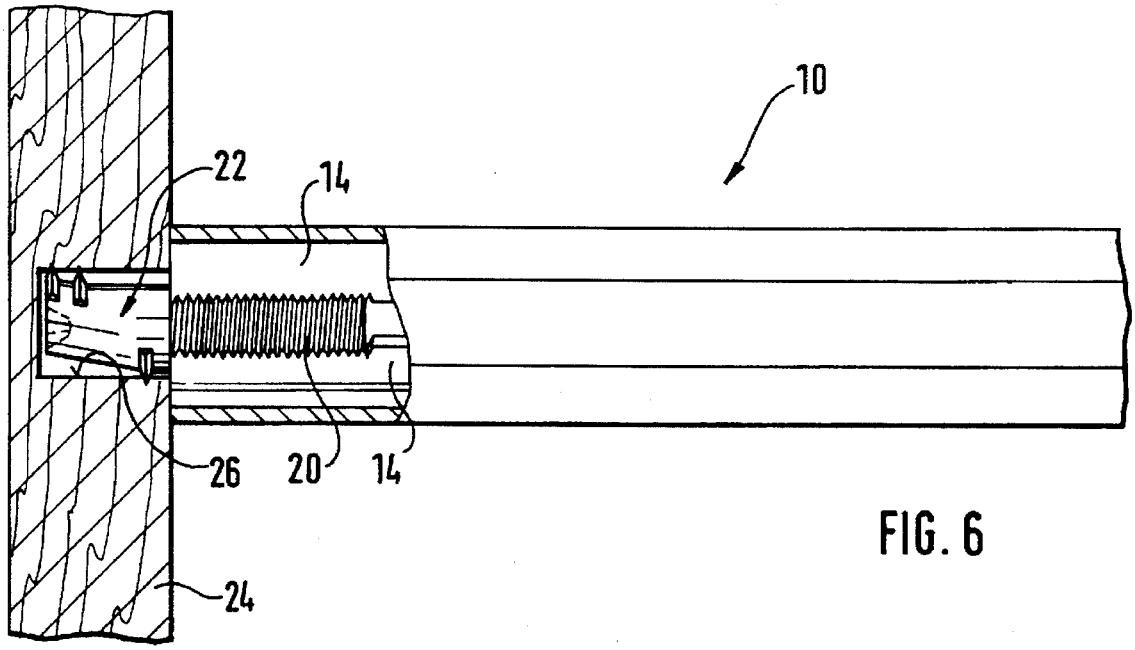

On the left end of the threaded shaft 20, as seen in FIGS. 1, 3 and 5 and 6 there is a fastening head 22 which can be introduced into a bore provided in a drawer front 24 in order to install the railing as represented in FIGS. 5 and 6. The fastening head is configured so that, in the inclined position represented in FIG. 5 it can be introduced without forcing into the bore 26, and then, when the railing 10 is lowered to the horizontal position in bore 26, it is locked positively in the bore 26. For this purpose the fastening head 22 is made to taper slightly from its base surface 28 toward its free end, but the taper runs at an angle from the base surface, which is at right angles to the longitudinal center axis of the threaded shaft 20, such that its upper generatrix 22*a* is more or less parallel to the axis of the threaded shaft and thus also parallel to the upper (or lower) boundary line of the railing 10. The lower generatrix 22*b* of the fastening head 22 runs accordingly at a greater angle of inclination than the generatrices or central axis of the railing 10.

In the front end of the fastening head 22 two radially extending, knife-edged projections 30*a* and 30*b* running circumferentially are provided at a slight distance apart. The projections run circumferentially only over about the upper third of the fastening head, while the projection 30*a* at the outer end, and projection 30*b*, offset slightly therefrom toward the threaded shaft 20, are a slight distance apart.

At a slight distance from the base surface 28, a knife-edged projection 32 reaches downwardly from the lower generatrix 22*b*, and it can be seen that the lower generatrix 22*b* runs parallel to the axis of the threaded shaft 20 in the area between projection 32 and base 28. On the other hand, the area lying between the upper projections 30*a* and 30*b* departs from the basically parallel orientation of the upper generatrix 22*a* and slopes downward toward the axis of the threaded shaft. In this aforesaid area between the projections 30*a* and 30*b*, the upper generatrix slopes in a manner correpsonding to the lower generatrix 22*b*.

Also the downwardly reaching sharpened projection 32 runs circumferentially only over less than half of circumference of the fastening head.

In the outer end of the fastening head there is provided a recess accessible to a screwdriver, and in this special case it is a cross slot 34, so that the free end of a blade of a cross-headed screwdriver can be introduced, by which the threaded shaft 20 of the fastener 12 can be driven into the screw thread in the railing 10.

What is claimed is:

1. A fastening device for fastening a hollow railing of a drawer to a drawer front having a blind bore with an opening at the surface of the drawer front facing the interior of the drawer, comprising;

a shaft having a threaded end capable of being screwed into an end of the hollow railing which faces the drawer front, a fastening head on the end of the shaft opposite the threaded end, said fastening head having a diameter larger than the diameter of the threaded end of the shaft and which is capable of being inserted into the bore on the drawer front, one end of the fastening head having a base surface for contacting the hollow railing when the threaded end of the shaft is completely screwed into the hollow railing, wherein the fastening head tapers conically from the end for contacting the hollow railing toward an opposite, free end of the fastening head, such that an upper generatrix of a vertical section through the fastening head runs from the hollow railing end of the fastening head over most of its length parallel to an upper generatrix of the hollow railing, and a lower generatrix slopes downward from the free end of the fastening head over most of its length, and in the area of the free end of the fastening head, at least one radial projection, projecting upwardly and having a knife edge, is provided and wherein the knife edge runs substantially circumferentially.

2. The fastening device according to claim 1, further comprising at least one projection, having a knife edge, in the area of the fastening head at the hollow railing end and which projects radially downwardly, and wherein the knife edge runs substantially circumferentially.

3. The fastening device according to claim 1, wherein two projections, projecting upwardly and having knife edges, are provided in the area of the free end of the fastening head, which are offset lengthwise from one another.

4. The fastening device according to claim 3, wherein a section of the upper generatrix lying between the two upwardly projecting projections is substantially parallel to the lower generatrix.

5. The fastening device according to claim 2, further comprising a second projection having a knife edge and projecting radially downwardly is provided at some distance from the base surface of the fastening head.

6. The fastening device according to claim 5, wherein a section of the lower generatrix of the fastening head provided between the base surface in the area adjacent the hollow railing and the projection is substantially parallel to an upper generatrix section running in an area from the hollow railing.

7. The fastening device according to claim 6, wherein the vertical distance measured in the midsection across the knife edges of the radially upwardly projecting projection and the radially downwardly projecting projection is greater than the diameter of the bore provided in the drawer front into which the fastening head is insertable.

* * * * *